US005908126A

United States Patent [19]

Wang

[11] Patent Number: 5,908,126

[45] Date of Patent: Jun. 1, 1999

[54] CAP ASSEMBLY HAVING A SUCKING MEMBER FOR A BOTTLE

[76] Inventor: Wen-Pin Wang, 11F-2, No. 43, Chi-I Street, Taichung, Taiwan

[21] Appl. No.: 09/002,790

[22] Filed: Jan. 5, 1998

[51] Int. Cl.[6] ..... B65D 41/00

[52] U.S. Cl. ..... 215/229; 215/235; 215/245; 215/387; 215/388; 220/254; 220/259; 220/705; 220/708; 220/810; 220/836; 220/837; 222/536

[58] Field of Search ..... 215/235, 237, 215/245, 229, 387–389; 220/705, 703, 707, 708, 709, 810, 836, 837, 254–256, 259; 222/533, 536, 556, 538

[56] References Cited

U.S. PATENT DOCUMENTS

| | | | |
|---|---|---|---|
| 3,023,939 | 3/1962 | Gustafson | 222/536 |
| 3,741,447 | 6/1973 | Miles et al. | 220/837 X |
| 4,081,108 | 3/1978 | Wilson et al. | 222/536 X |
| 4,298,146 | 11/1981 | Montgomery | 222/536 |
| 4,903,870 | 2/1990 | La Vange . | |
| 5,065,912 | 11/1991 | Rosenthal | 222/536 X |
| 5,332,131 | 7/1994 | Pehr . | |
| 5,524,799 | 6/1996 | Skillin | 222/536 X |

*Primary Examiner*—Stephen K. Cronin
*Assistant Examiner*—Robin A. Hylton
*Attorney, Agent, or Firm*—Charles E. Baxley Esq.

[57] ABSTRACT

A cap assembly includes a first part for mounting to a bottle and a second part coupled to the first part, and a sucking member pivotally disposed to a top of the first part. The top of the first part has two stands, a support located between the two stands and a stop extending therefrom, wherein the support has a passage defined therethrough and extending through the top. The sucking member has a sphere member rotatably supported between the two stands and is rested on a first annular flange extending from a top of the support. The second part has two clamping members extending from a bottom thereof so that when the second part is mounted to the first part, the sucking member is clamped by the clamping members and pivoted and laid on the stop.

8 Claims, 3 Drawing Sheets

CAP ASSEMBLY HAVING A SUCKING MEMBER FOR A BOTTLE

BACKGROUND OF THE INVENTION

1. Field of the Invention

The present invention relates to a cap assembly and, more particularly, to an improved cap assembly threadedly connected to a bottle and having a sucking member pivotally disposed thereto so as to conveniently suck juice or water in the bottle.

2. Brief Description of the Prior Art

Conventionally, a cap is threadedly connected to a threaded neck of a bottle so that when one wants to drink juice or water in the bottle, he/she should remove the cap and have the juice or water directly via the open top of the bottle. The threaded neck of the bottle is easily contaminated because users' mouths contact the threaded portion frequently. The cap also is easily get lost because the cap has to be removed from the bottle. Furthermore, once the threaded periphery of the cap is deformed, it will be difficult to mount it on the bottle. In addition, children cannot drink directly by putting a rim defining the open top of the bottle on their lips so that straws should always be carried with their parents.

The present invention intends to provide an improved cap assembly for a bottle to mitigate and/or obviate the above-mentioned problems.

SUMMARY OF THE INVENTION

In one aspect of the present invention, there is provided a cap assembly comprising a first part which has a top having a hole defined therethrough. Two stands extend upwardly from the top and each of the stands has a recess defined in a top thereof. A tubular support located between the two stands extends upwardly from a periphery defining the hole and has a first annular flange extending upwardly from a top thereof. A passage is defined longitudinally through the support and communicates with the hole. A stop extends upwardly from the top and located away from the support.

A second part is coupled to the first part by a flexible connector so that the second part is able to be mounted to the first part. Two clamping members extend from a bottom thereof.

A sucking member includes a tube and a sphere member formed to a lower end of the tube, wherein a central passage is defined longitudinally through the tube and the sphere member. Two rods extend diametrically in opposite from the sphere member so as to be pivotally and unmovably received in the two recesses of the two stands and the sphere member is rested on the first annular flange.

It is an object of the present invention to provide a cap assembly having a sucking member disposed therein.

It is another object: of the present invention to provide a cap assembly which provides a sucking member to access liquid in a bottle.

It is a further object of the present invention to provide a cap assembly which has a second part to cover the sucking member when not used.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
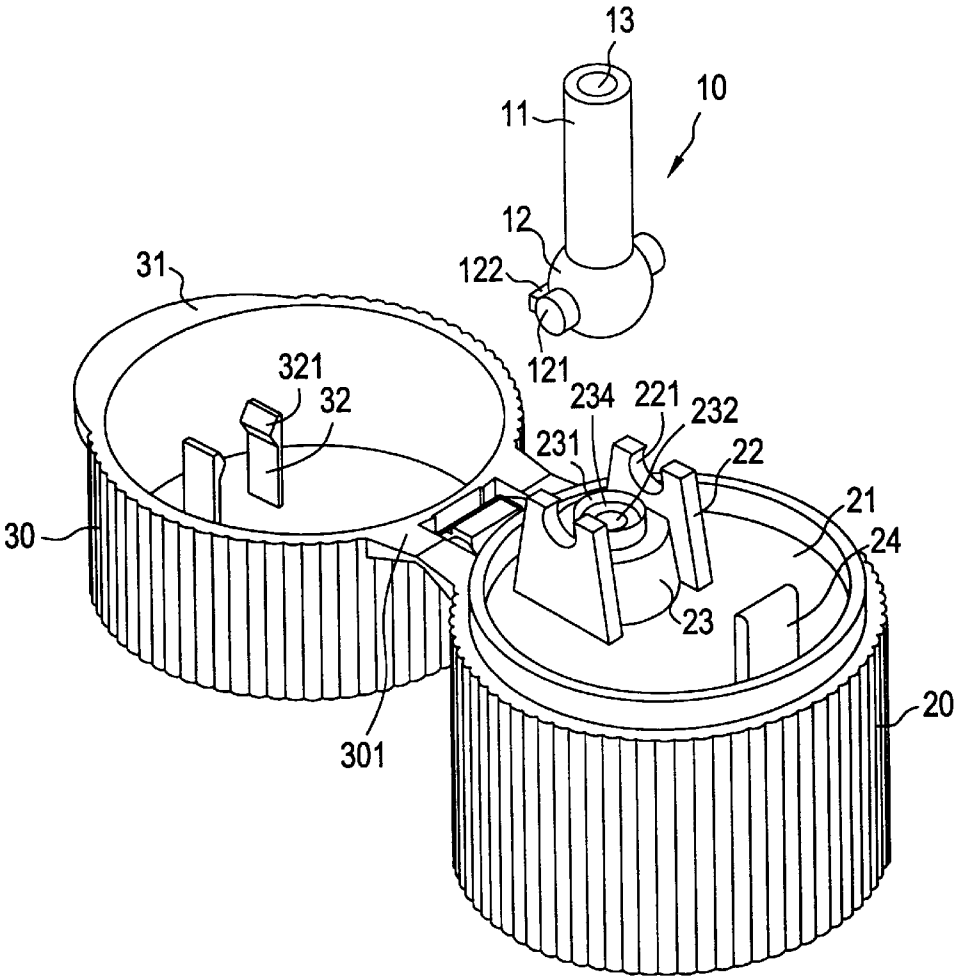
FIG. 1 is an exploded view of a cap assembly having a sucking member in accordance with the present invention.
Figure 2:
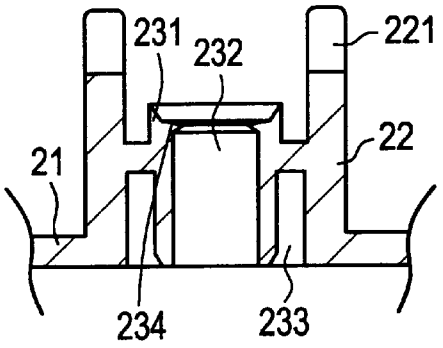
FIG. 2 is a sectional view to show part of the support and two stands of the present invention.

Referring to the drawings and initially to FIGS. 1 and 2, a cap assembly in accordance with the present invention generally includes a first part 20 having a top 21 through which a hole 210 is defined, a second part 30 coupled to the first part 20 by a flexible connector 301 so that the second part 30 is able to be mounted to the first part 20, and a sucking member 10 pivotally disposed to the first part 20. Two stands 22 extend upwardly from the top 21 and each of the stands 22 has a recess 221 defined in a top thereof. A tubular support 23 extends upwardly from a periphery defining the hole 210 and is located between the two stands 22. A passage 232 is defined longitudinally through the support 23 and communicates with the hole 210. The support 23 has a first annular flange 231 extending upwardly from a top thereof and a second annular flange 234 extending inwardly and radially from an inner periphery defining the passage 232 on the top thereof, wherein each of the first and the second annular flange 231, 234 is made of flexible material. The support 23 further has an annular recess 233 defined in a bottom thereof so as to receive one of two ends of a sucking pipe 50 which extends in a bottle 40 (see FIG. 4). A stop 24 extends upwardly from the top 21 and is located away from the support 23.

The second part 30 has two clamping members 32 extending from a bottom thereof and each of the clamping members 32 has a protrusion 321 extending laterally from a top thereof. The second part 30 has a lip 31 extending laterally and outwardly from an upper edge thereof so that the second part 30 can be conveniently disengaged from the first part 20 by lifting the lip 31 upwardly by a user's thumb.

Figure 3:
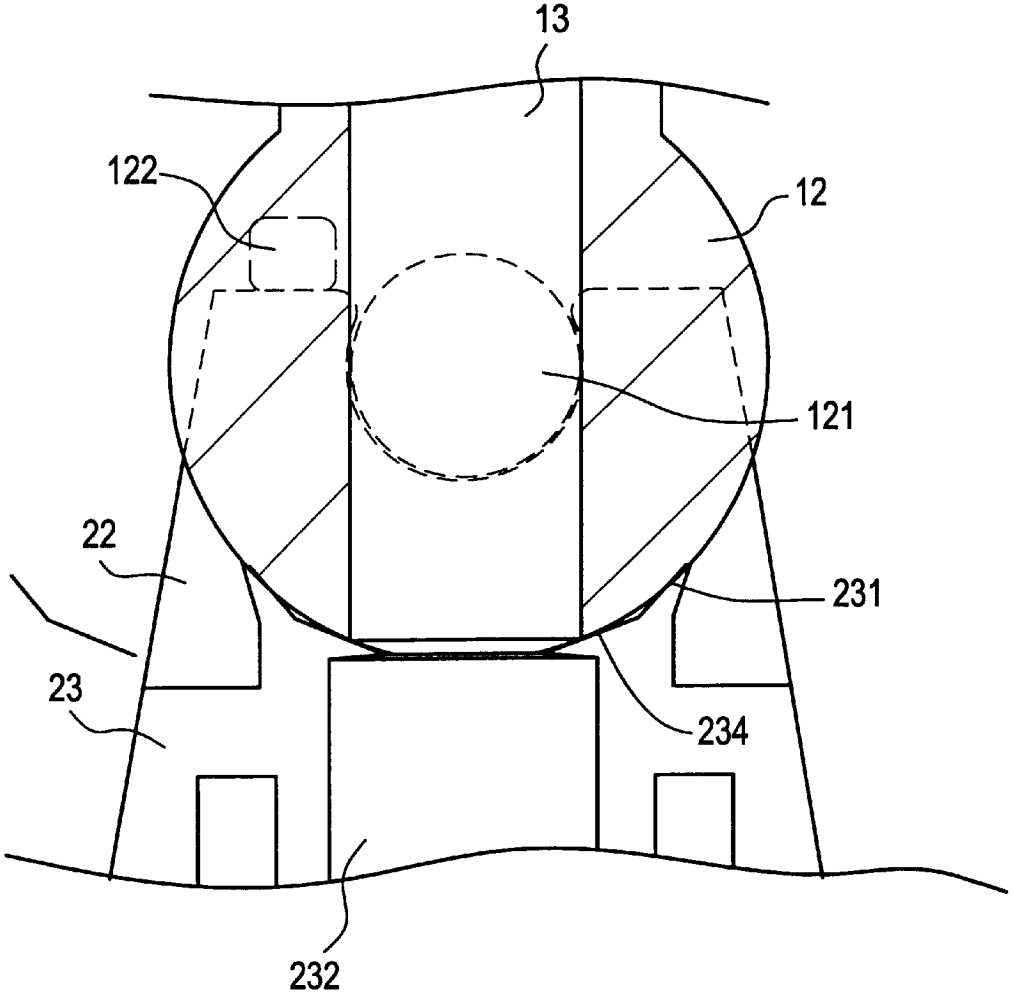
FIG. 3 is an illustrative view to show a rib of the sucking member contacting a top of one of the two stands, when the sucking member is in an upright position.

The sucking member 10 includes a tube 11 and a sphere member 12 formed to a lower end of the tube 11. A central passage 13 is defined longitudinally through the tube 11 and the sphere member 12. Two rods 121 extend diametrically in opposite from the sphere member 12 so as to be pivotally and unmovably received in the two recesses 221 of the two stands 22 and the sphere member 12 is rotatably rested on the first annular flange 231. Further referring to FIG. 3, the sphere member 12 has two ribs 122 extending outwardly therefrom so as to contact a top of each of the two stands 22 when the sucking member 10 is pivoted to an upright position. In addition, a distance between the two clamping members 32 is sized to receive the tube 11 of the sucking member 10.

Figure 5:
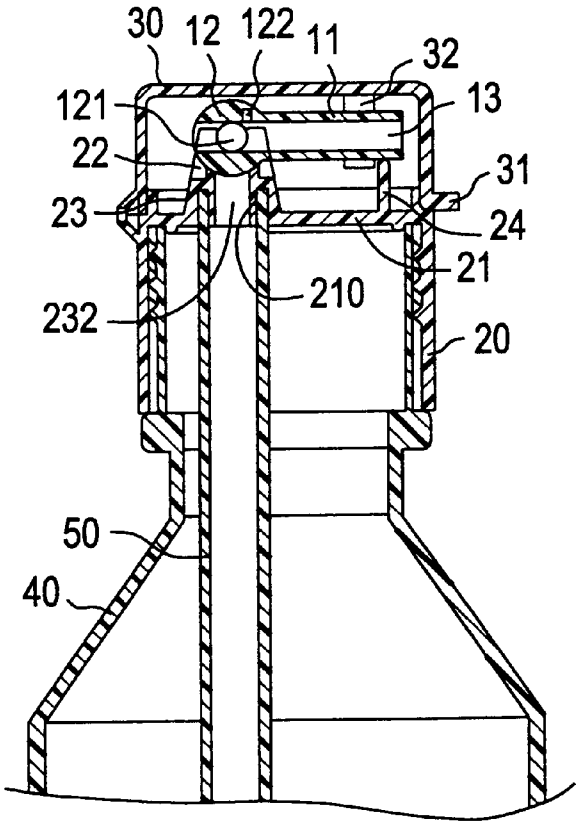
FIG. 5 is a side elevational view, partly in section, of the cap assembly mounted to a bottle, wherein the sucking member is pivoted downwardly by closing a second part of the cap assembly.

Referring to FIG. 4 again, the first and the second annular flange 231, 234 ensure a seal effect between the sphere member 12 and the passage 232. When the sucking member 10 is in an upright position, the user (not shown) can suck drink in the bottle 40 via the sucking pipe 50, the hole 210, the passage 232 and the central passage 13. Referring to FIG. 5, when mounting the second part 30 onto the first part

Figure 4:
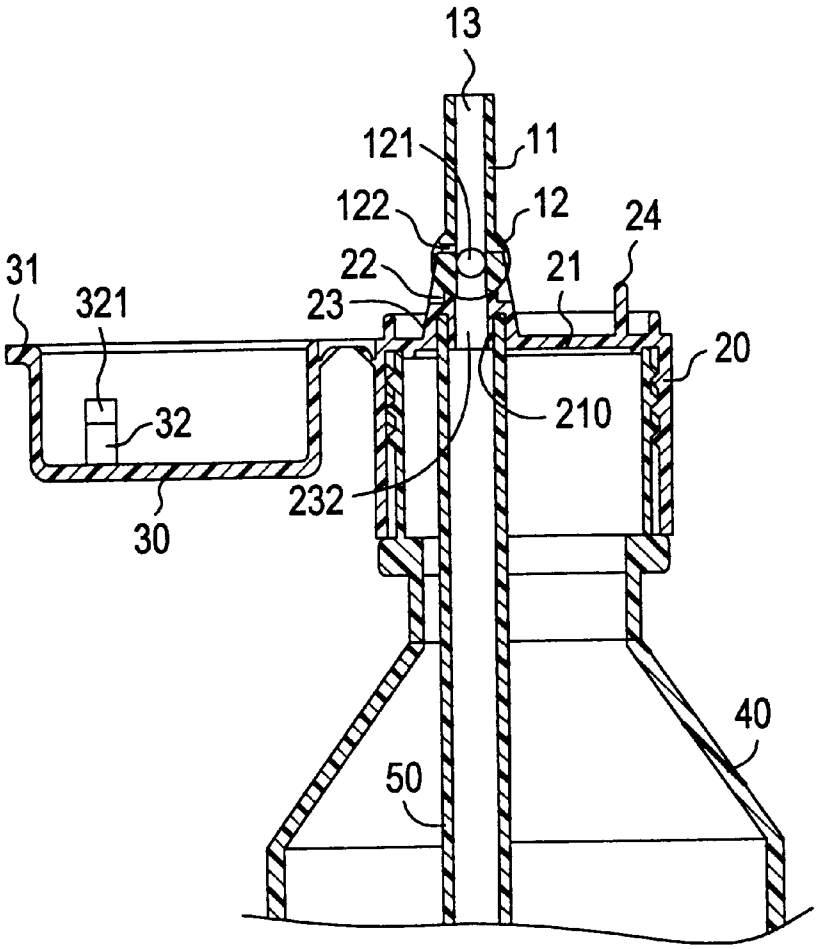
FIG. 4 is a side elevational view, partly in section, of the cap assembly mounted to a bottle, wherein the sucking member is in the upright position.

20, the two clamping members 32 will moved with the second part 30 and push the tube 11 downwardly. When the tube 11 contacts the stop 24, the tube 11 will be force-fitted between the two clamping members 32 as shown in FIG. 5. Further referring to FIG. 3, when opening the second part 30 by lifting the lip 31, the tube 11 is moved with the two clamping members 32 till two ribs 122 contact one of the two stands 22, and then the two clamping members 32 will be forced to disengage from the tube 11 as shown in FIG. 4.

Therefore, the cap assembly provides a convenient function to have drink in the bottle 40 without screwing the cap. The sucking member 10 especially suitable for kids to use.

Although the invention has been explained in relation to its preferred embodiment, it is to be understood that many other possible modifications and variations can be made without departing from the spirit and scope of the invention as hereinafter claimed.

What is claimed is:

1. A cap assembly comprising:

a first part having a top through which a hole is defined, two stands extending upwardly from said top and each of said stands having a recess defined in a top thereof, a tubular support extending upwardly from a periphery defining said hole and located between said two stands, a passage defined longitudinally through said support and communicating with said hole, said support having a first annular flange extending upwardly from a top thereof, a stop extending upwardly from said top and located away from said support;

a second part coupled to said first part by a flexible connector so that said second part is mounted to said first part in a closed position, two clamping members extending from a bottom thereof, and a sucking member including a tube and a sphere member formed to a lower end of said tube, a central passage defined longitudinally through said tube and said sphere member, two rods extending diametrically in opposite from directions relative to one another said sphere member so as to be pivotally and unmovably received in said two recesses of said two stands, said sphere member being rested on said first annular flange.

2. The cap assembly as claimed in claim 1 wherein said sphere member has two ribs extending outwardly therefrom so as to contact a top of each of said two stands when said sucking member is pivoted to an upright position.

3. The cap assembly as claimed in claim 1 wherein a second annular flange extends inwardly and radially from an inner periphery defining said passage on said top of said support.

4. The cap assembly as claimed in claim 1 wherein said support has an annular recess defined in a bottom thereof so as to receive an end of a sucking pipe.

5. The cap assembly as claimed in claim 1 wherein a distance between said two clamping members is sized to receive said tube of said sucking member.

6. The cap assembly as claimed in claim 1 wherein said second part has a lip extending laterally and outwardly from an upper edge thereof.

7. The cap assembly as claimed in claim 3 wherein each of said first and said second annular flange is made of flexible material.

8. The cap assembly as claimed in claim 1 wherein each of said clamping members has a protrusion extending laterally from a top thereof.

* * * * *